US007065935B2

(12) United States Patent
Ralf

(10) Patent No.: US 7,065,935 B2
(45) **Date of Patent: *Jun. 27, 2006**

(54) METHOD FOR LAYING AND INTERLOCKING PANELS

(75) Inventor: Eisermann Ralf, Cochem (DE)

(73) Assignee: Akzenta Paneele & Profile GmbH, Kaisersesch (DE)

( * ) Notice: Subject to any disclaimer, the term of this patent is extended or adjusted under 35 U.S.C. 154(b) by 148 days.

This patent is subject to a terminal disclaimer.

(21) Appl. No.: 10/911,280

(22) Filed: Aug. 4, 2004

(65) Prior Publication Data

US 2005/0005559 A1 Jan. 13, 2005

Related U.S. Application Data

(63) Continuation of application No. 09/609,251, filed on Jun. 30, 2000, now Pat. No. 6,804,926, which is a continuation of application No. PCT/DE00/00870, filed on Jun. 22, 2000.

(30) Foreign Application Priority Data

Jul. 2, 1999 (DE) ..... 299 11 462 U

(51) Int. Cl.
*E04F 15/02* (2006.01)

(52) U.S. Cl. ..... 52/747.1; 52/592.1; 52/592.2

(58) Field of Classification Search ..... 52/747.1, 52/747.11, 592.1, 592.2
See application file for complete search history.

(56) References Cited

U.S. PATENT DOCUMENTS 338,653 A 3/1886 Whitmore
890,436 A 6/1908 Momberg (Continued)

FOREIGN PATENT DOCUMENTS

BE 417526 10/1936

(Continued)

OTHER PUBLICATIONS

WEBSTER'S II New Riverside University Dictionary, 1984, 'scarf', pp. 1042-1043, Houghton Mifflin Company, Boston, MA.

*Primary Examiner*—Robert Canfield
(74) *Attorney, Agent, or Firm*—Whiteford, Taylor & Preston LLP

(57) ABSTRACT

Rectangular floor panels, a fastening system for joining the panels, and a method for laying and interlocking the panels are disclosed. The panels are provided complementary, form-fitting retaining profiles extending over the length of the sides. The complementary edges of the panels allow two adjacent panels to be positively joined such that displacement of the panels away from one another is prevented, while enabling articulation of the panels with respect to one another at the joint location. The method of installation provides for installing a new panel to a first row and a panel in a second row by first joining the new panel to the panel of the second row at its short side, followed by pivoting the new panel upwards out of the plane of the laid panels along its long side, along with at least the adjacent end of the first panel in the second row, into an inclined position, and sliding the new panel into the retaining profile of the panels in the first row. The new panel and the raised end of the panel in the second row are then pivoted down into the plane of the laid panels. Laying of panels continues according to this process until the complete floor assembly has been laid.

20 Claims, 7 Drawing Sheets

U.S. PATENT DOCUMENTS

| | | | | |
|---|---|---|---|---|
| 1,776,188 | A | 9/1930 | Langbaum | |
| 1,854,396 | A | 4/1932 | Davis | |
| 2,138,085 | A | 11/1938 | Birtles | 20/78 |
| 2,142,305 | A | 1/1939 | Davis | 72/68 |
| 2,381,469 | A | 8/1945 | Sweet | 20/4 |
| 2,430,200 | A | 11/1947 | Wilson | 20/92 |
| 2,740,167 | A | 4/1956 | Rowley | 20/8 |
| 3,040,388 | A | 6/1962 | Conn | 20/6 |
| 3,172,508 | A | 3/1965 | Doering et al. | 189/34 |
| 3,175,476 | A | 3/1965 | Franks | 94/13 |
| 3,192,574 | A | 7/1965 | Jaffe et al. | 20/8 |
| 3,200,553 | A | 8/1965 | Frashour et al. | 52/595 |
| 3,310,919 | A | 3/1967 | Bue et al. | 52/127 |
| 3,347,048 | A | 10/1967 | Brown et al. | 61/37 |
| 3,526,420 | A | 9/1970 | Brancaleone | 287/189.36 |
| 3,579,941 | A | 5/1971 | Tibbals | 52/384 |
| 3,657,852 | A | 4/1972 | Worthington et al. | 52/591 |
| 3,673,751 | A | 7/1972 | Boassy et al. | 52/169 |
| 3,902,291 | A | 9/1975 | Zucht | 52/284 |
| 3,988,187 | A | 10/1976 | Witt et al. | 156/71 |
| 4,094,090 | A | 6/1978 | Walmer | 46/19 |
| 4,416,097 | A | 11/1983 | Weir | 52/220 |
| 4,426,820 | A | 1/1984 | Terbrack et al. | 52/594 |
| 4,599,841 | A | 7/1986 | Haid | 52/403 |
| 4,741,136 | A | 5/1988 | Thompson | 52/302 |
| 4,807,416 | A | 2/1989 | Pasrasin | 52/595 |
| 4,819,532 | A | 4/1989 | Benuzzi et al. | 83/100 |
| 4,819,932 | A | 4/1989 | Trotter, Jr. | 272/3 |
| 5,086,599 | A | 2/1992 | Meyerson | 52/309.9 |
| 5,165,816 | A | 11/1992 | Parasin | 403/334 |
| 5,274,979 | A | 1/1994 | Tsai | 52/595 |
| 5,283,102 | A | 2/1994 | Sweet et al. | 428/167 |
| 5,295,341 | A | 3/1994 | Kajiwara | 52/586.2 |
| 5,348,778 | A | 9/1994 | Knipp et al. | |
| 5,363,616 | A | 11/1994 | Hernandez | 52/281 |
| 5,618,602 | A | 4/1997 | Nelson | 428/60 |
| 5,630,304 | A | 5/1997 | Austin | 52/384 |
| 5,706,621 | A | 1/1998 | Pervan | 52/403.1 |
| 5,797,237 | A | 8/1998 | Finkell, Jr. | 52/589.1 |
| 5,860,267 | A | 1/1999 | Pervan | 52/748.1 |
| 6,006,486 | A | 12/1999 | Moriau et al. | 52/589.1 |
| 6,023,907 | A | 2/2000 | Pervan | 52/748.1 |
| 6,029,416 | A | 2/2000 | Andersson | 52/592.1 |
| 6,094,882 | A | 8/2000 | Pervan | 52/745.19 |
| 6,098,365 | A | 8/2000 | Martin et al. | 52/592.1 |
| 6,101,778 | A | 8/2000 | Martensson | 52/582.1 |
| 6,122,879 | A | 9/2000 | Montes | 52/592.1 |
| 6,182,410 | B1 | 2/2001 | Pervan | 52/403.1 |
| 6,209,278 | B1 | 4/2001 | Tychsen | 52/592.4 |
| 6,216,409 | B1 | 4/2001 | Roy et al. | 52/589.1 |
| 6,324,803 | B1 * | 12/2001 | Pervan | 52/403.1 |
| 6,324,809 | B1 | 12/2001 | Nelson | 52/592.2 |
| 6,397,548 | B1 | 6/2002 | Martin et al. | 52/592.4 |
| 6,418,683 | B1 * | 7/2002 | Martensson et al. | 52/282.1 |
| 6,490,836 | B1 | 12/2002 | Moriau et al. | 52/589.1 |
| 6,505,452 | B1 | 1/2003 | Hannig et al. | 52/582.1 |
| 6,513,862 | B1 | 2/2003 | Dodson et al. | 296/155 |
| 6,546,691 | B1 | 4/2003 | Leopolder | 52/747.1 |
| 6,591,568 | B1 | 7/2003 | Pålsson | 52/592.2 |
| 6,606,834 | B1 | 8/2003 | Martensson et al. | 52/578 |
| 6,647,690 | B1 | 11/2003 | Martensson | 52/601 |
| 6,672,030 | B1 * | 1/2004 | Schulte | 52/747.1 |
| 6,715,253 | B1 * | 4/2004 | Pervan | 52/578 |
| 6,804,926 | B1 * | 10/2004 | Eisermann | 52/592.1 |
| 6,968,664 | B1 * | 11/2005 | Thiers et al. | 52/592.1 |
| 2002/0092263 | A1 * | 7/2002 | Schulte | 52/747.1 |
| 2002/0112433 | A1 | 8/2002 | Pervan | 52/592.1 |
| 2002/0170258 | A1 | 11/2002 | Schwitte et al. | 52/592.1 |
| 2003/0024200 | A1 | 2/2003 | Moriau et al. | 52/592.1 |
| 2003/0024201 | A1 | 2/2003 | Moriau et al. | 52/592.1 |
| 2003/0029115 | A1 | 2/2003 | Moriau et al. | 52/592.1 |
| 2003/0029116 | A1 | 2/2003 | Moriau et al. | 52/592.1 |

FOREIGN PATENT DOCUMENTS

| | | | |
|---|---|---|---|
| BE | 418853 | | 1/1937 |
| BE | 765.817 | | 9/1971 |
| CA | 991373 | B | 6/1976 |
| CA | 2150384 | A1 | 11/1994 |
| CH | 200949 | | 11/1938 |
| CH | 562377 | | 4/1975 |
| DE | 1 963 128 | | 6/1967 |
| DE | DT 2 159 042 | | 6/1973 |
| DE | 7402354 | | 5/1974 |
| DE | DT 25 02 992 | A1 | 7/1976 |
| DE | DT 26 16 077 | A1 | 10/1977 |
| DE | 29 17 025 | A1 | 11/1980 |
| DE | G 79 28 703 | U1 | 7/1981 |
| DE | 30 41 781 | A1 | 6/1982 |
| DE | 31 17 605 | A1 | 11/1982 |
| DE | 33 43 601 | A1 | 6/1985 |
| DE | G 90 04 451.7 | | 8/1990 |
| DE | 41 22 099 | C1 | 10/1992 |
| DE | 42 15 273 | A1 | 11/1993 |
| DE | 195 03 948 | A1 | 8/1996 |
| DE | 299 11 462 | U1 | 12/1999 |
| EP | 0 024 360 | A1 | 3/1981 |
| EP | 0 085 196 | A1 | 8/1983 |
| EP | 0 161 233 | B1 | 10/1987 |
| EP | 0 248 127 | A1 | 12/1987 |
| EP | 0 562 402 | A1 | 9/1993 |
| EP | 0 698 162 | B1 | 2/1996 |
| EP | 0 715 037 | A1 | 6/1996 |
| EP | 0 843 763 | B1 | 12/1997 |
| EP | 0 844 963 | B1 | 6/1998 |
| EP | 0 855 482 | B1 | 7/1998 |
| EP | 0 877 130 | B1 | 11/1998 |
| FR | 1.215.852 | | 4/1960 |
| FR | 1.293.043 | | 12/1962 |
| FR | 1.511.292 | | 1/1968 |
| FR | 2.135.372 | | 12/1972 |
| FR | 2 278 876 | | 2/1976 |
| FR | 2 416 988 | | 9/1979 |
| FR | 2 568 295 | A1 | 1/1986 |
| FR | 2 691 491 | A1 | 11/1993 |
| GB | 424057 | | 2/1935 |
| GB | 599793 | | 3/1948 |
| GB | 812671 | | 4/1959 |
| GB | 1127915 | | 9/1968 |
| GB | 1 237 744 | | 6/1971 |
| GB | 1 275 511 | | 5/1972 |
| GB | 1 430 423 | | 3/1976 |
| GB | 2 117 813 | A | 10/1983 |
| GB | 2 256 023 | A | 11/1992 |
| JP | 03-169967 | A2 | 7/1991 |
| JP | 04203141 | | 7/1992 |
| JP | 05304714 | | 11/1993 |
| JP | 7-180333 | | 7/1995 |
| JP | 08-109734 | | 4/1996 |
| SE | 7114900-9 | | 12/1974 |
| SE | 457 737 | | 1/1989 |
| WO | WO 84/02155 | A1 | 6/1984 |
| WO | WO 93/13280 | A1 | 7/1993 |
| WO | WO 96/27719 | A1 | 9/1996 |
| WO | WO 99/66151 | A1 | 12/1999 |
| WO | WO 00/63510 | A1 | 10/2000 |
| WO | WO 01/02669 | A1 | 1/2001 |
| WO | WO 01/02671 | A1 | 1/2001 |
| WO | WO 01/51732 | A1 | 7/2001 |

* cited by examiner

METHOD FOR LAYING AND INTERLOCKING PANELS

CROSS-REFERENCE TO RELATED APPLICATIONS

This application is a continuation of and co-owned U.S. patent application Ser. No. 09/609,251, filed with the U.S. Patent and Trademark Office on Jun. 30, 2000 entitled "Method for Laying and Interlocking Panels", now U.S. Pat. No. 6,804,926, which is a continuation of PCT/DE00/00870, filed Jun. 22, 2000 in Germany by the inventor herein, the specifications of which are incorporated herein by reference.

BACKGROUND OF THE INVENTION

1. Field of the Invention

The invention relates to a method for laying and interlocking panels, particularly via a fastening system consisting of positive retaining profiles provided on the narrow sides of the panels, which extend over the length of the narrow sides and are provided with joint projections or complementary joint recesses.

2. Background of the Prior Art

German utility model G 79 28 703 U1 describes a generic method for laying and interlocking floor panels with positive retaining profiles. These retaining profiles can be connected to each other by means of a rotary connecting movement. However, the disadvantage is that, in order to lay a second row of panels that is to be attached to a laid first row of panels, the second row first has to be completely assembled. The technical teaching to be taken from utility model G 79 28 703 U1 is that a first row of panels initially has to be laid ready horizontally and that a start is then made with a second panel in a second row, which has to be held at an angle and slid into a groove formed in the first panel row. The second panel has to be held at this angle, so that a third panel can be connected to the second panel. The same applies to the subsequent panels that have to be connected to each other in the second row. Only once all the panels of the second panel row have been pre-assembled in an inclined position can the entire second panel row be swung into horizontal position, this causing it to interlock with the first panel row. The unfavorable aspect of the laying method required for this panel design is the fact that several persons are required in order to hold all the panels of a second panel row in an inclined position for pre-assembly and then to jointly lower the second panel row into the laying plane.

Another method for laying and interlocking panels is known from EP 0 855 482 A2. In this case, panels to be laid in the second row are again connected to the panels of a first row in an inclined position. Adjacent panels of the second row are initially interlocked with the panels of the first row, leaving a small lateral distance between them. In this condition, the panels of the second row can be displaced along the first row. Retaining profiles provided on the short narrow sides of the panels are pressed into each other by sliding two panels of the second row against each other. Disadvantageously, the retaining profiles are greatly expanded and elongated during this process. Even during assembly, the retaining profiles already suffer damage that impairs the durability of the retaining profiles. The retaining profiles designed and laid according to the teaching of EP 0 855 482 A2 are not suitable for repeated laying. For example, retaining profiles molded from HDF or MDF material become soft as a result of the high degree of deformation to which the retaining profiles are subjected by the laying method according to EP 0 855 482 A2. Internal cracks and shifts in the fiber structure of the HDF or MDF material are responsible for this.

The object of the invention is thus to simplify the method for laying and interlocking panels and to improve the durability of the fastening system.

SUMMARY OF THE INVENTION

According to the invention, the object is solved by a method for laying and interlocking rectangular, plate-shaped panels, particularly floor panels, the opposite long narrow sides and opposite short narrow sides of which display retaining profiles extending over the length of the narrow sides, of which the opposite retaining profiles are designed to be essentially complementary to each other, where a first row of panels is initially connected on the short narrow sides, either in that the complementary retaining profiles of a laid panel and a new panel are slid into each other in the longitudinal direction of the short narrow sides, or in that the retaining profile of a new panel is initially inserted in an inclined position relative to the laid panel having the complementary retaining profile of the laid panel and subsequently interlocked, both in the direction perpendicular to the connected narrow ends and in the direction perpendicular to the plane of the laid panels, by pivoting into the plane of the laid panel, the next step being to lay a new panel in the second row, in that the retaining profile of its long narrow side is initially inserted into the retaining profile of the long narrow side of a panel of the first row by positioning at an angle relative to it and subsequently pivoting into the plane of the laid panels, and where a new panel, the short narrow side of which must be interlocked with the short narrow side of the panel laid in the second row and the long narrow side of which must be connected to the long narrow side of a panel laid in the first row, is first interlocked with the panel of the second row at its short narrow end, the new panel then being pivoted upwards out of the plane of the laid panels along the long narrow side of a panel laid in the first row, where the panel of the second row that was previously interlocked with the new panel on the short narrow side is also pivoted upwards, at least at this end, together with the new panel, into an inclined position in which the long retaining profile of the new panel can be inserted into the complementary retaining profile of the panel laid in the first row and, after insertion, the inclined new panel and the panel interlocked with the new panel on a short narrow side in the second row are pivoted into the plane of the laid panels.

According to the new method, panels to be laid in the second row can be fitted by a single person. A new panel can be interlocked both with panels of a first row and with a previously laid panel of the second row. This does not require interlocking of the short narrow sides of two panels lying in one plane in a manner that expands and deforms the retaining profiles.

The last panel laid in the second row can be gripped by its free, short narrow end and can be pivoted upwards into an inclined position about the interlocked, long narrow side as the pivoting axis. The panel is slightly twisted about its longitudinal axis in this process. The result of this is that the free, short narrow end of the panel is in an inclined position and the inclination decreases towards the interlocked, short narrow end of the panel. Depending on the stiffness of the panels, this can result in more or less strong torsion and thus in a greater or lesser decrease in the inclination. In the event of relatively stiff panels, the inclination can continue through several of the previous panels in the second row.

When laying, it is, of course, not necessary for the first row to be laid completely before making a start on laying the second row. During laying, attention must merely be paid to ensuring that the number of elements in the first row is greater than that in the second row, and so on.

The method can be realized particularly well when using thin, easily twisted panels. The inclination of a thin panel located in the second row decreases over a very short distance when subjected to strong torsion. The non-twisted remainder of a panel, or of a panel row, located in the laying plane, is securely interlocked. Only on the short, inclined part of the last panel of the second row can the retaining profiles of the long narrow sides become disengaged during the laying work. However, they can easily be re-inserted together with the new panel attached at the short narrow side.

A particularly flexible and durable design is one consisting of rectangular, plate-shaped panels that display complementary retaining profiles extending over the length of the narrow sides on narrow sides parallel to each other, where one retaining profile is provided in the form of a joint projection with a convex curvature and the complementary retaining profile in the form of a joint recess with a concave curvature, where each joint projection of a new panel is inserted into the joint recess of a laid panel, expanding it only slightly, and the new panel is finally interlocked by pivoting into the plane of the laid panel. The deformation of the retaining profiles required for laying and interlocking is considerably smaller than with retaining profiles that have to be pressed together perpendicular to their narrow sides in the laying plane. Advantageously, the joint projection does not protrude from the narrow side by more than the thickness of the panel. In this way, another advantage lies in the fact that the retaining profile can be milled on the narrow side of a panel with very little waste.

When laid, the retaining profiles of the long narrow sides of two panels, which can also be referred to as form-fitting profiles, form a common joint, where the upper side of the joint projection facing away from the substrate preferably displays a bevel extending to the free end of the joint projection, and where the bevel increasingly reduces the thickness of the joint projection towards the free end and the bevel creates freedom of movement for the common joint.

The design permits articulated movement of two connected panels. In particular, two connected panels can be bent upwards at the point of connection. If, for example, one panel lies on a substrate with an elevation, with the result that one narrow side of the panel is pressed onto the substrate when loaded, and the opposite narrow side rises, a second panel fastened to the rising narrow side is also moved upwards. However, the bending forces acting in this context do not damage the narrow cross-sections of the form-fitting profiles. An articulated movement takes place instead.

A floor laid using the proposed fastening system displays an elasticity adapted to irregularly rough or undulating substrates. The fastening system is thus particularly suitable for panels for renovating uneven floors in old buildings. Of course, it is also more suitable than the known fastening system when laying panels on a soft intermediate layer.

The design caters to the principle of "adapted deformability". This principle is based on the knowledge that very stiff, and thus supposedly stable, points of connection cause high notch stresses and can easily fail as a result. In order to avoid this, components are to be designed in such a way that they display a degree of elasticity that is adapted to the application, or "adapted deformability", and that notch stresses are reduced in this way.

Moreover, the form-fitting profiles are designed in such a way that a load applied to the upper side of the floor panels in laid condition is transmitted from the upper side wall of the joint recess of a first panel to the joint projection of the second panel and from the joint projection of the second panel into the lower-side wall of the first panel. When laid, the walls of the joint recess of the first panel are in contact with the upper and lower side of the joint projection of the second panel. However, the upper wall of the joint recess is only in contact with the joint projection of the second panel in a short area on the free end of the upper wall of the joint recess. In this way, the design permits articulated movement between the panel with the joint recess and the panel with the joint projection, with only slight elastic deformation of the walls of the joint recess. In this way, the stiffness of the connection is optimally adapted to an irregular base, which inevitably leads to a bending movement between panels connected to each other.

Another advantage is seen as lying in the fact that the laying and interlocking method according to the invention is more suitable for repeated laying than the known methods, because the panels display no damage to the form-fitting profiles after repeated laying and after long-term use on an uneven substrate. The form-fitting profiles are dimensionally stable and durable. They can be used for a substantially longer period and re-laid repeatedly during their life cycle.

Advantageously, the convex curvature of the joint projection and the concave curvature of the joint recess each essentially form a segment of a circle where, in laid condition, the center of the circle of the segments of the circle is located on the upper side of the joint projection or below the upper side of the joint projection. In the latter case, the center of the circle is located within the cross-section of the joint projection.

This simple design results in a joint where the convex curvature of the joint projection is designed similarly to the ball, and the concave curvature of the joint recess similarly to the socket, of a ball-and-socket joint, where, of course, in contrast to a ball-and-socket joint, only planar rotary movement is possible and not spherical rotary movement.

In a favorable configuration, the point of the convex curvature of the joint projection of a panel that protrudes farthest is positioned in such a way that it is located roughly below the top edge of the panel. This results in a relatively large cross-section of the joint projection in relation to the overall thickness of the panel. Moreover, the concave curvature of the joint recess offers a sufficiently large under-cut for the convex curvature of the joint projection, so that tensile forces acting in the laying plane can hardly move the panels apart.

The articulation properties of two panels connected to each other can be further improved if the inside of the wall of the joint recess of a panel that faces the substrate displays a bevel extending up to the free end of the wall and the wall thickness of this wall becomes increasingly thin towards the free end. In this context, when two panels are laid, the bevel creates space for movement of the common joint. This improvement further reduces the amount of elastic deformation of the walls of the joint recess when bending the laid panels upwards.

It is also expedient if the joint recess of a panel for connecting to the joint projection of a second panel can be expanded by resilient deformation of its lower wall and the resilient deformation of the lower wall occurring during connection is eliminated again when connection of the two panels is complete. As a result, the form-fitting profiles are only elastically deformed for the connection operation and during joint movement, not being subjected to any elastic stress when not loaded.

The ability also to connect the short narrow ends of two panels in articulated fashion benefits the resilience of a floor covering.

The form-fitting profiles preferably form an integral part of the narrow sides of the panels. The panels can be manufactured very easily and with little waste.

The laying method is particularly suitable if the panels consist essentially of an MDF (medium-density fiberboard), HDF (high-density fiberboard), or particleboard material. These materials are easy to process and can be given a sufficient surface quality by means of cutting processes, for example. In addition, these materials display good dimensional stability of the milled profiles.

The various features of novelty that characterize the invention will be pointed out with particularity in the claims of this application.

BRIEF DESCRIPTION OF THE DRAWINGS

An example of the invention is illustrated in a drawing and described in detail below on the basis of FIGS. 1 to 9. The figures show the following.

DETAILED DESCRIPTION OF THE INVENTION

Figure 1:
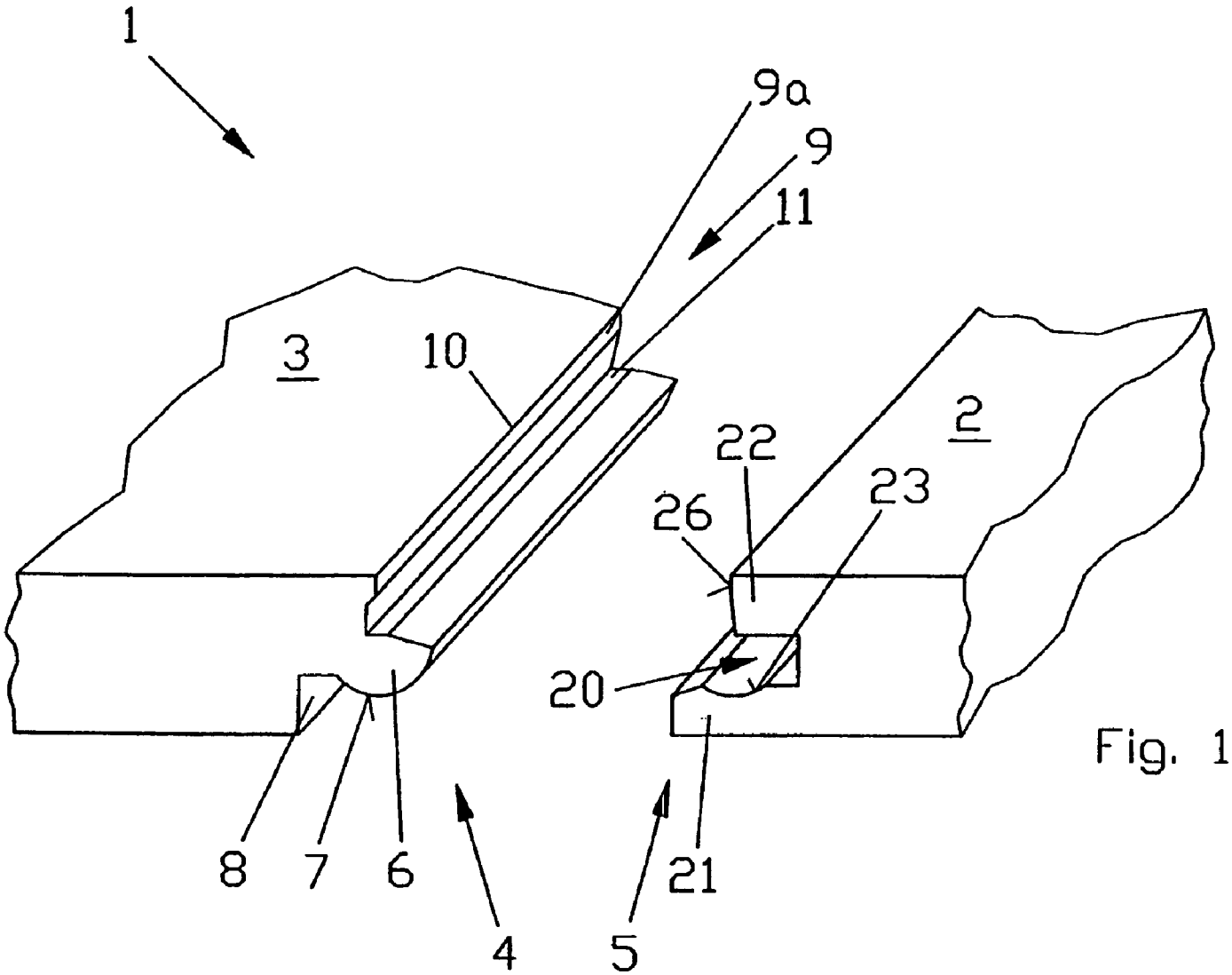
FIG. 1—Part of a fastening system on the basis of the cross-sections of two panels prior to connection, FIG. 2—The fastening system as per FIG. 1 in assembled condition, FIG. 3—A connecting procedure, where the joint projection of one panel is inserted in the joint recess of a second panel in the direction of the arrow and the first panel is subsequently locked in place by a rotary movement, FIG. 4—A further connecting procedure, where the joint projection of a first panel is slid into the joint recess of a second panel parallel to the laying plane, FIG. 5—The fastening system in laid condition as per FIG. 2, where the common joint is moved upwards out of the laying plane and the two panels form a bend, FIG. 6—The fastening system in laid condition as per FIG. 2, where the common joint is moved downwards out of the laying plane and the two panels form a bend, FIG. 7—A fastening system in the laid condition of two panels, with a filler material between the form-fitting profiles of the narrow sides, FIG. 8—A perspective representation of the method for laying and interlocking rectangular panels, FIG. 9—An alternative method for laying and interlocking rectangular panels.

According to the drawing, fastening system 1, required for the method for laying and interlocking rectangular panels, is explained based on oblong, rectangular panels 2 and 3, a section of which is illustrated in FIG. 1. Fastening system 1 displays retaining profiles, which are located on the narrow sides of the panels and designed as complementary form-fitting profiles 4 and 5. The opposite form-fitting profiles of a panel are of complementary design in each case. In this way, a further panel 3 can be attached to every previously laid panel 2.

Form-fitting profiles 4 and 5 are based on the prior art according to German utility model G 79 28 703 U1, particularly on the form-fitting profiles of the practical example. The form-fitting profiles according to the invention are developed in such a way that they permit the articulated and resilient connection of panels.

One of the form-fitting profiles 4 of the present invention is provided with a joint projection 6 protruding from one narrow side. For the purpose of articulated connection, the lower side of joint projection 6, which faces the base in laid condition, displays a cross-section with a convex curvature 7. Convex curvature 7 is mounted in rotating fashion in complementary form-fitting profile 5. In the practical example shown, convex curvature 7 is designed as a segment of a circle. Part 8 of the narrow side of panel 3, which is located below joint projection 6 and faces the base in laid condition, stands farther back from the free end of joint projection 6 than part 9 of the narrow side, which is located above joint projection 6. In the practical example shown, part 8 of the narrow side, located below joint projection 6, recedes roughly twice as far from the free end of joint projection 6 and part 9 of the narrow side, located above joint projection 6. The reason for this is that the segment of a circle of convex curvature 7 is of relatively broad design. As a result, the point of convex curvature 7 of joint projection 6 that projects farthest is positioned in such a way that it is located roughly below top edge 10 of panel 3.

Part 9 of the narrow side, located above joint projection 6, protrudes from the narrow side on the top side of panel 3, forming abutting joint surface 9*a*. Part 9 of the narrow side recedes between this abutting joint surface 9*a* and joint projection 6. This ensures that part 9 of the narrow side always forms a closed, top-side joint with the complementary narrow side of the second panel 2.

The upper side of joint projection 6, opposite convex curvature 7 of joint projection 6, displays a short, straight section 11 that is likewise positioned parallel to substrate U in laid condition. From this short section 11 to the free end, the upper side of joint projection 6 displays a bevel 12 that extends up to the free end of joint projection 6.

Form-fitting profile 5 of a narrow side, which is complementary to form-fitting profile 4 described, displays a joint recess 20. This is essentially bordered by a lower wall 21 that faces substrate U in laid condition, and an upper wall 22. On the inside of joint recess 20, lower wall 21 is provided with a concave curvature 23. Concave curvature 23 is likewise designed in the form of a segment of a circle. In order for there to be sufficient space for the relatively broad concave curvature 23 on lower wall 21 of joint recess 20, lower wall 21 projects farther from the narrow side of panel 2 than upper wall 22. Concave curvature 23 forms an undercut at the free end of lower wall 21. In finish-laid condition of two panels 2 and 3, this undercut is engaged by joint projection 6 of associated form-fitting profile 4 of adjacent panel 3. The degree of engagement, meaning the difference between the thickest point of the free end of the lower wall and the thickness of the lower wall at the lowest point of concave curvature 23, is such that a good compromise is obtained between flexible resilience of two panels 2 and 3 and good retention to prevent form-fitting profiles 4 and 5 being pulled apart in the laying plane.

In comparison, the fastening system of the prior art utility model G 79 28 703 U1 displays a considerably greater degree of undercut. This results in extraordinarily stiff points of connection, which cause high notch stresses when subjected to stress on an uneven substrate.

According to the practical example, the inner side of upper wall 22 of joint recess 20 of panel 2 is positioned parallel to substrate U in laid condition.

On lower wall 21 of joint recess 20 of panel 2, which faces substrate U, the inner side of wall 21 has a bevel 24 that extends up the free end of lower wall 21. As a result, the wall thickness of this wall becomes increasingly thin towards the free end. According to the practical example, bevel 24 follows on from the end of concave curvature 23.

Figure 2:
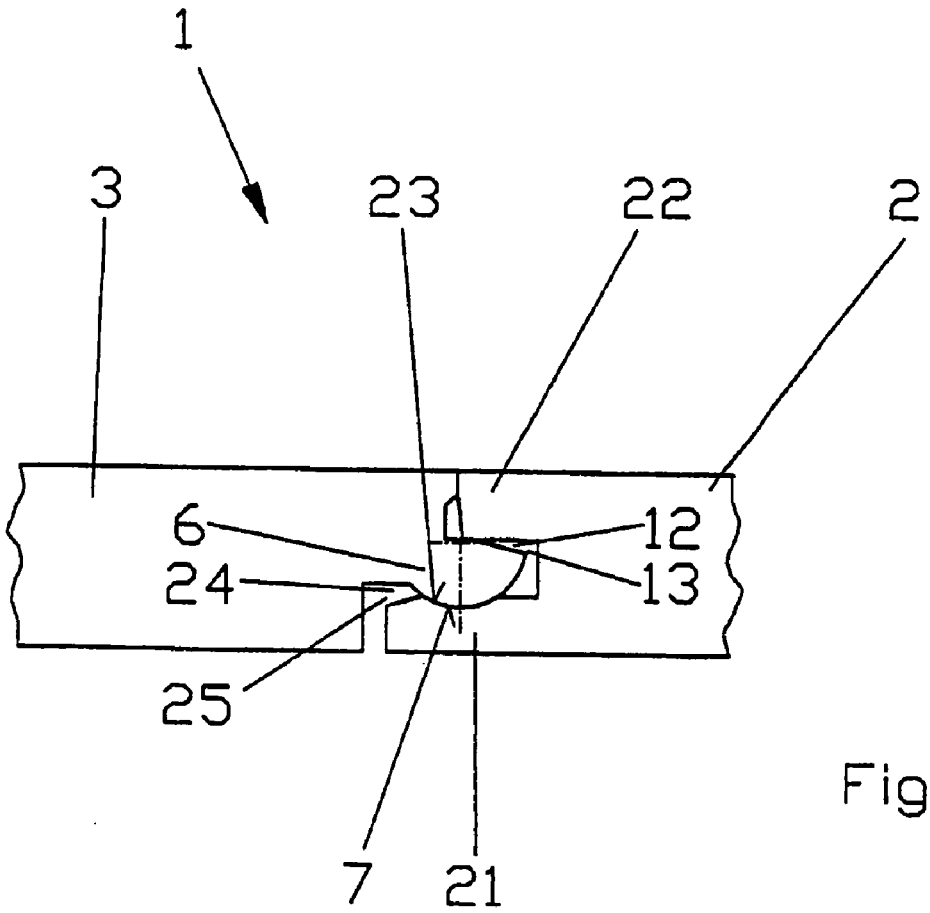

Joint projection 6 of panel 3 and joint recess 20 of panel 2 form a common joint G, as illustrated in FIG. 2. When panels 2 and 3 are laid, the previously described bevel 12, on the upper side of joint projection 6 of panel 3, and bevel 24 of lower wall 21 of joint recess 20 of panel 2 create spaces for movement 13 and 25, which allow joint G to rotate over a small angular range.

In laid condition, short straight section 11 of the upper side of joint projection 6 of panel 3 is in contact with the inner side of upper wall 22 of joint recess 20 of panel 2. Moreover, convex curvature 7 of joint projection 6 lies against concave curvature 23 of lower wall 21 of joint recess 20 of panel 2.

Lateral abutting joint surfaces 9*a* and 26 of two connected panels 2 and 3, which face the upper side, are always definitely in contact. In practice, simultaneous exact positioning of convex curvature 7 of joint projection 6 of panel 3 against concave curvature 23 of joint recess 20 of panel 2 is impossible. Manufacturing tolerances would lead to a situation where either abutting joint surfaces 9*a* and 26 are positioned exactly against each other or joint projection 6/recess 20 are positioned exactly against each other. In practice, the form fitting profiles are thus designed in such a way that abutting joint surfaces 9*a* and 26 are always exactly positioned against each other and joint projection 6/recess 20 cannot be moved far enough in each other to achieve an exact fit. However, as the manufacturing tolerances are in the region of hundredths of a millimeter, joint projection 6/recess 20 also fit almost exactly.

Figure 3:
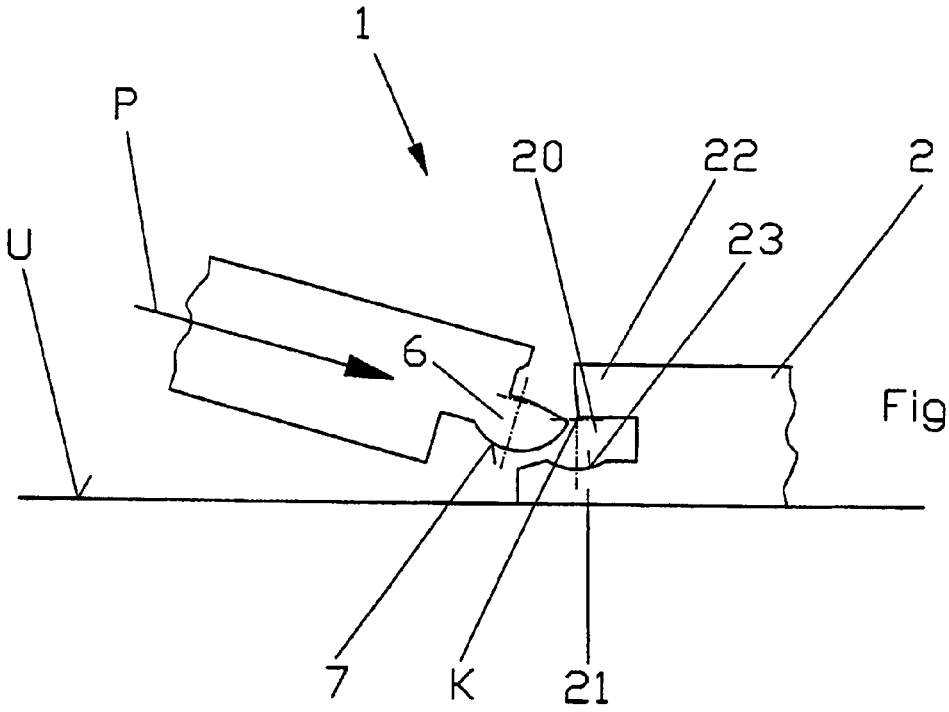

Panels 2 and 3, with complementary form-fitting profiles 4 and 5 described, can be fastened to each other in a variety of ways. According to FIG. 3, one panel 2 with a joint recess 20 has already been laid, while a second panel 3, with a complementary joint projection 6, is being inserted into joint recess 20 of first panel 2 at an angle in the direction of the arrow P. After this, second panel 3 is rotated about the common center of circle K of the segments of a circle of convex curvature 7 of joint projection 6 and concave curvature 23 of joint recess 20 until second panel 3 lies on substrate U.

Figure 4:
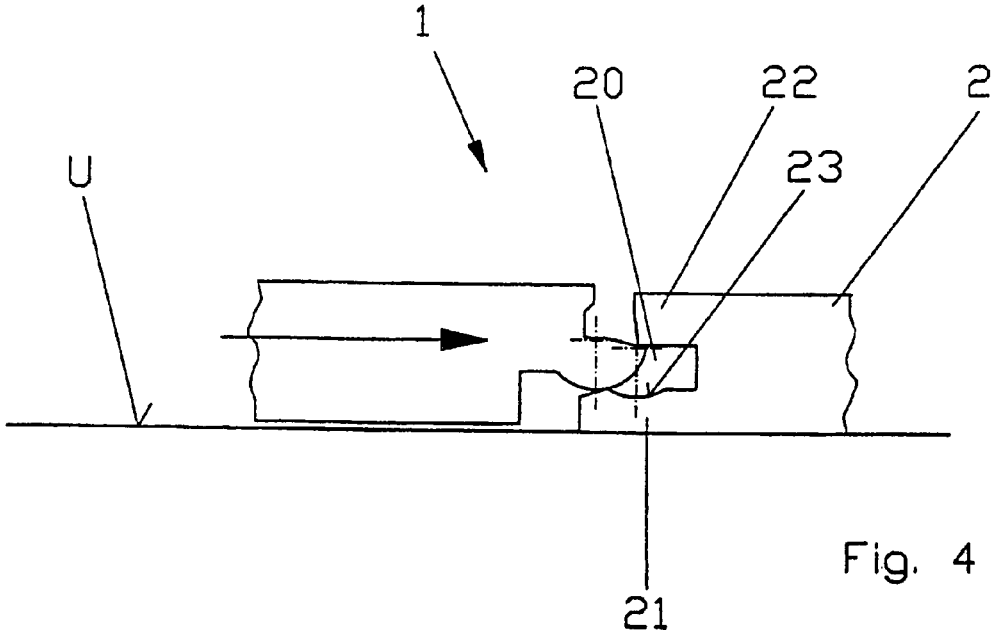

Another way of joining the previously described panels 2 and 3 is illustrated in FIG. 4, according to which first panel 2 with joint recess 20 has been laid and a second panel 3 with joint projection 6 is slid in the laying plane and perpendicular to form-fitting profiles 4 and 5 in the direction of the arrow P until walls 21 and 22 of joint recess 20 expand elastically to a small extent and convex curvature 7 of joint projection 6 has overcome the undercut at the front end of concave curvature 23 of the lower wall and the final laying position is reached.

The latter way of joining is preferably used for the short narrow sides of a panel if these are provided with the same complementary form-fitting profiles 4 and 5 as the long narrow sides of the panels.

Figure 5:
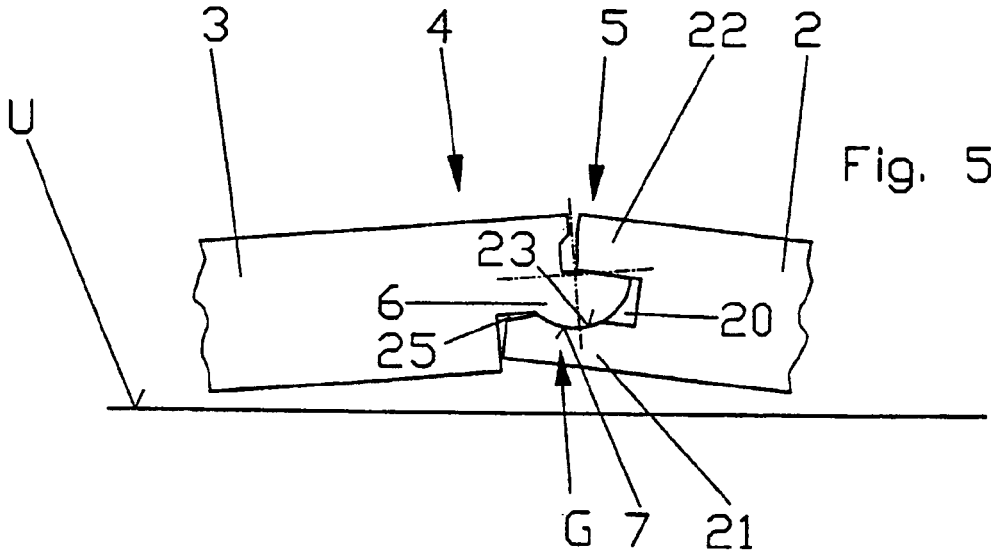

FIG. 5 illustrates fastening system 1 in use. Panels 2 and 3 are laid on an uneven substrate U. A load has been applied to the upper side of first panel 2 with form-fitting profile 5. The narrow side of panel 2 with form-fitting profile 5 has been lifted as a result. Form-fitting profile 4 of panel 3, which is connected to form-fitting profile 5, has also been lifted. Joint G results a bend between the two panels 2 and 3. The spaces for movement 13 and 25 create room for the rotary movement of the joint. Joint G, formed by the two panels 2 and 3, has been moved slightly upwards out of the laying plane. Space for movement 13 has been utilized to the full for rotation, meaning that the area of bevel 12 on the upper side of joint projection 6 of panel 3 is in contact with the inner side of wall 22 of panel 2. The point of connection is inherently flexible and does not impose any unnecessary, material-fatiguing bending loads on the involved form-fitting profiles 4 and 5.

The damage soon occurring in form-fitting profiles according to the prior art, owing to the breaking of the joint projection or the walls of the form-fitting profiles, is avoided in this way.

Another advantage results in the event of movement of the joint in accordance with FIG. 5. This can be seen in the fact that, upon relief of the load, the two panels drop back into the laying plane under their own weight. Slight elastic deformation of the walls of the joint recess is also present in this case. This elastic deformation supports the panels in dropping back into the laying plane. Only very slight elastic deformation occurs because the center of motion of the joint, which is defined by curvatures 7 and 23 with the form of a segment of a circle, is located within the cross-section of joint projection 6 of panel 3.

Figure 6:
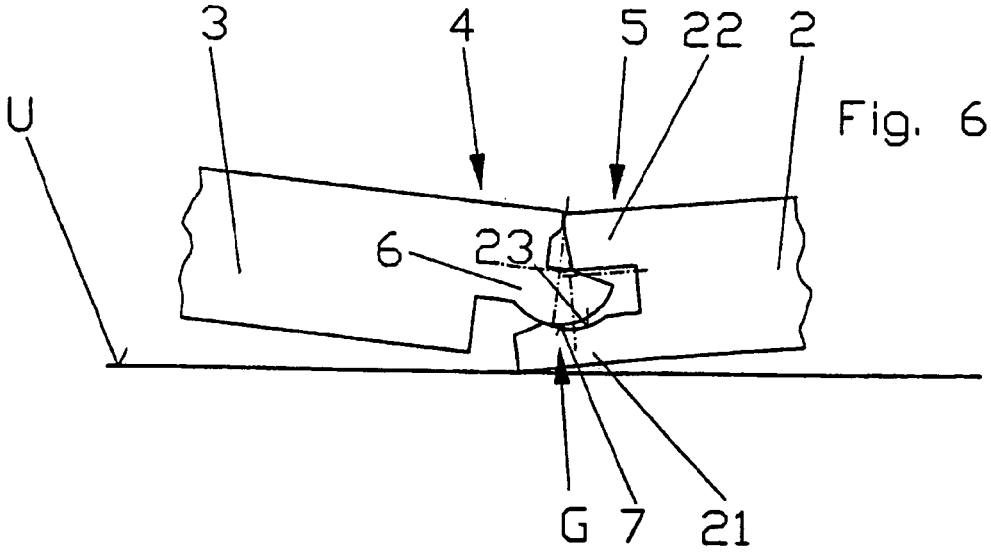

FIG. 6 illustrates movement of the joint of two laid panels 2 and 3 in the opposite sense of rotation. Panels 2 and 3, laid on uneven substrate U, are bent downwards. The design is such that, in the event of downward bending of the point of connection out of the laying plane towards substrate U, far more pronounced elastic deformation of lower wall 21 of joint recess 20 occurs than during upward bending from the laying plane. This measure is necessary because downward-bent panels 2 and 3 cannot return to the laying plane as a result of their own weight when the load is relieved. However, the greater elastic deformation of lower wall 21 of joint recess 20 generates an elastic force that immediately moves panels 2 and 3 back into the laying plane in the manner of a spring when the load is relieved.

In the present form, the previously described form-fitting profiles 4 and 5 are integrally molded on the narrow sides of panels 2 and 3. This is preferably achieved by means of a so-called formatting operation, where a number of milling tools connected in series mills the shape of form-fitting profiles 4 and 5 into the narrow sides of panels 2 and 3. Panels 2 and 3 of the practical example described essentially consist of MDF board with a thickness of 8 mm. The MDF board has a wear-resistant and decorative coating on the upper side. A so-called counteracting layer is applied to the lower side in order to compensate for the internal stresses caused by the coating on the upper side.

Figure 7:
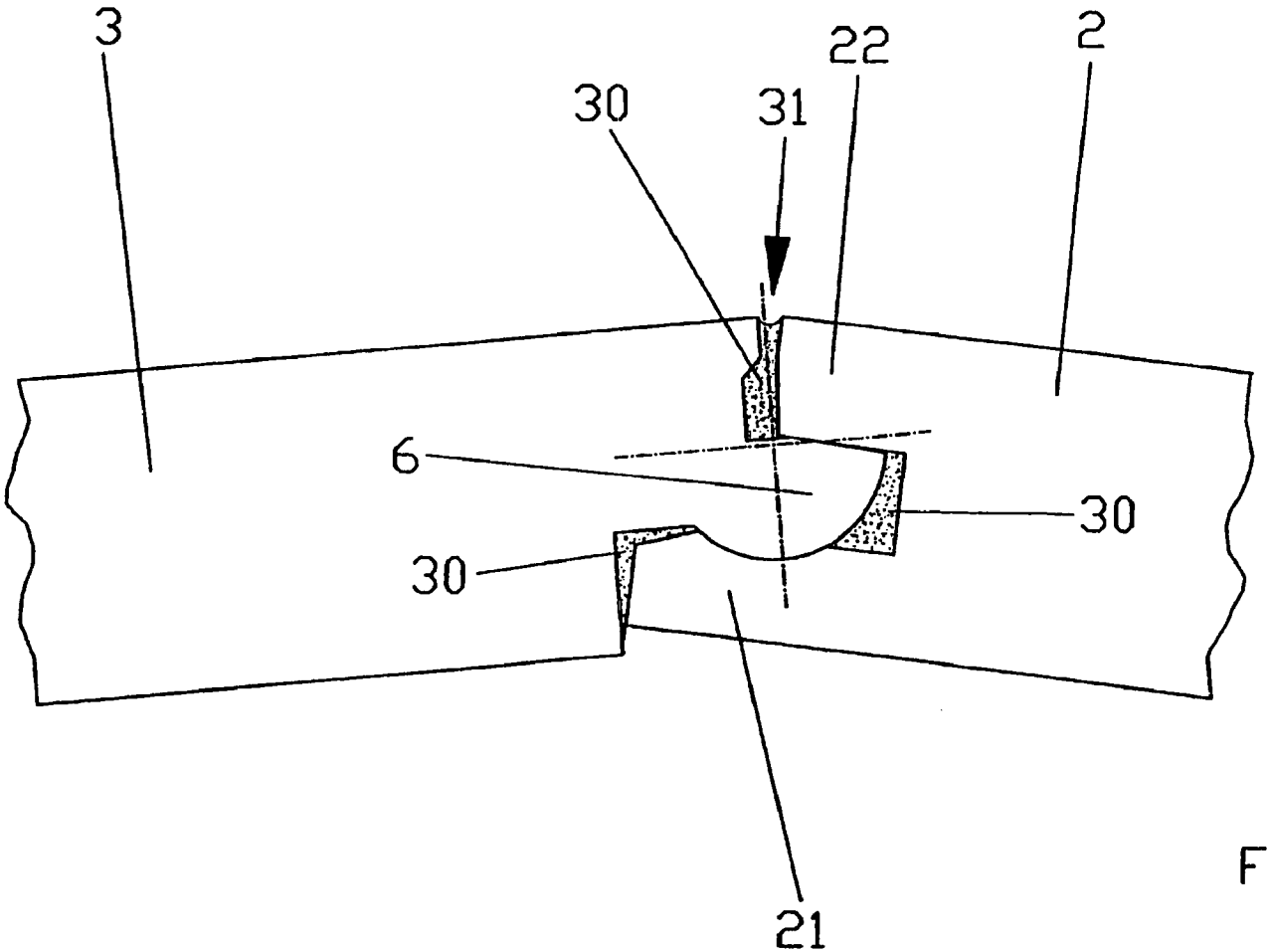

Finally, FIG. 7 shows two panels 2 and 3 in laid condition, where fastening system 1 is used with a filler 30 that remains flexible after curing. Filler 30 is provided between all adjacent parts of the positively connected narrow sides. In particular, the top-side joint 31 is sealed with the filler to prevent the ingress of any moisture or dirt. In addition, the elasticity of filler 30, which is itself deformed when two panels 2 and 3 are bent, brings about the return of panels 2 and 3 to the laying plane.

Figure 8:
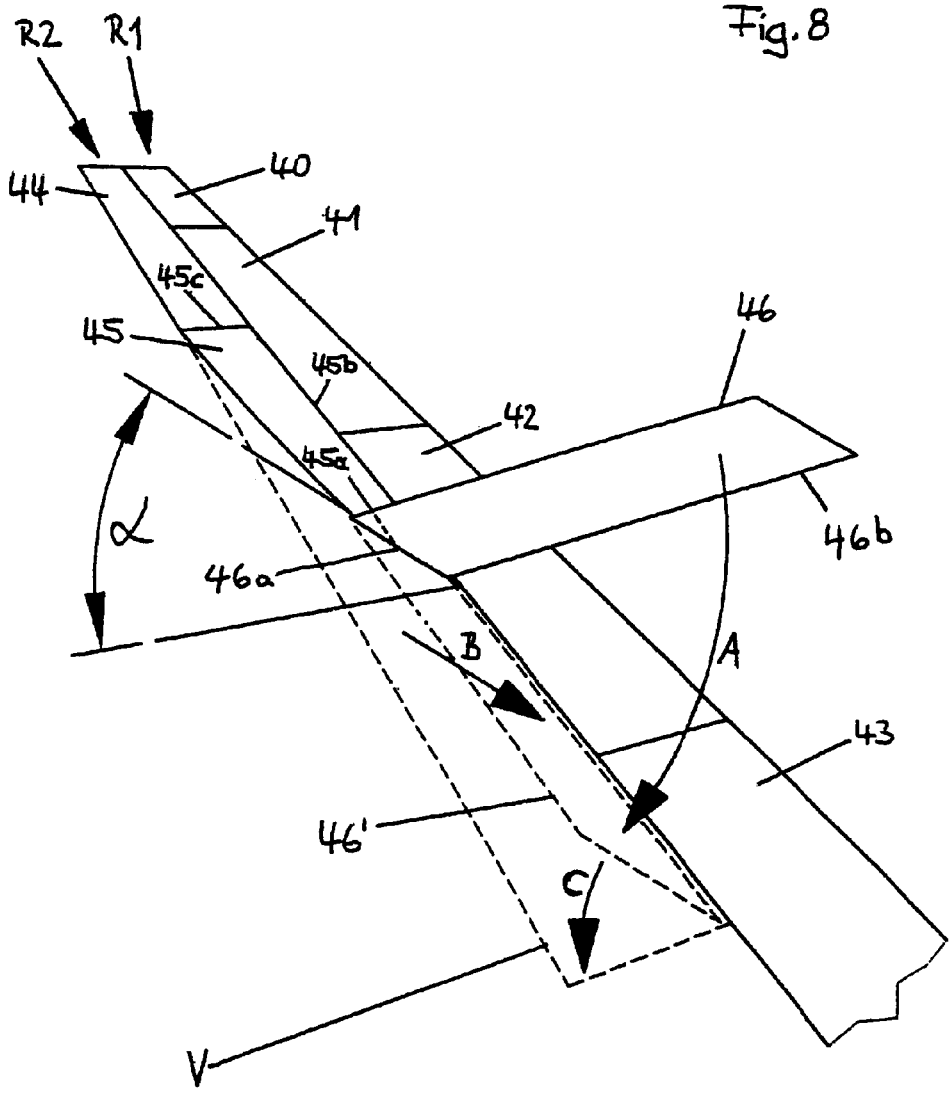

FIG. 8 shows a perspective representation of the laying of a floor, where the method for laying and interlocking panels according to the invention is used. For the sake of the simplicity of the drawing, the details of the retaining profiles have been omitted. However, these correspond to the form-fitting profiles in FIGS. 1 to 7 and display profiled joint projections and complementary joint recesses that extend over the entire length of the narrow sides.

A first row R1, comprising rectangular, plate-like panels 40, 41, 42 and 43, can be seen. Panels 40, 41, 42 and 43 of first row R1 are preferably laid in such a way that joint recesses are always located on the free sides of a laid panel and new panels can be attached by their joint projections to the joint recesses of the laid panels.

Panels 40, 41, 42 and 43 of fist row R1 have been interlocked at their short sides. This can be done either in the laying plane by sliding the panels laterally into each other in the longitudinal direction of the retaining profiles of the short narrow sides or, alternatively, by joining the retaining profiles while positioning a new panel at an angle relative to a laid panel and subsequently pivoting the new panel into the laying plane. The laying plane is indicated by broken line V in FIGS. 8 and 9. The retaining profiles have been interlocked without any major deformation in both cases. The panels are interlocked in the direction perpendicular to the laying plane. Moreover, they are also interlocked in the direction perpendicular to the plane of the narrow sides.

Panels 44, 45 and 46 are located in a second row R2. First, the long side of panel 44 was interlocked by inserting its joint projection by positioning it at an angle relative to the panels of first row R1 and subsequently pivoting panel 44 into the laying plane.

Figure 9:
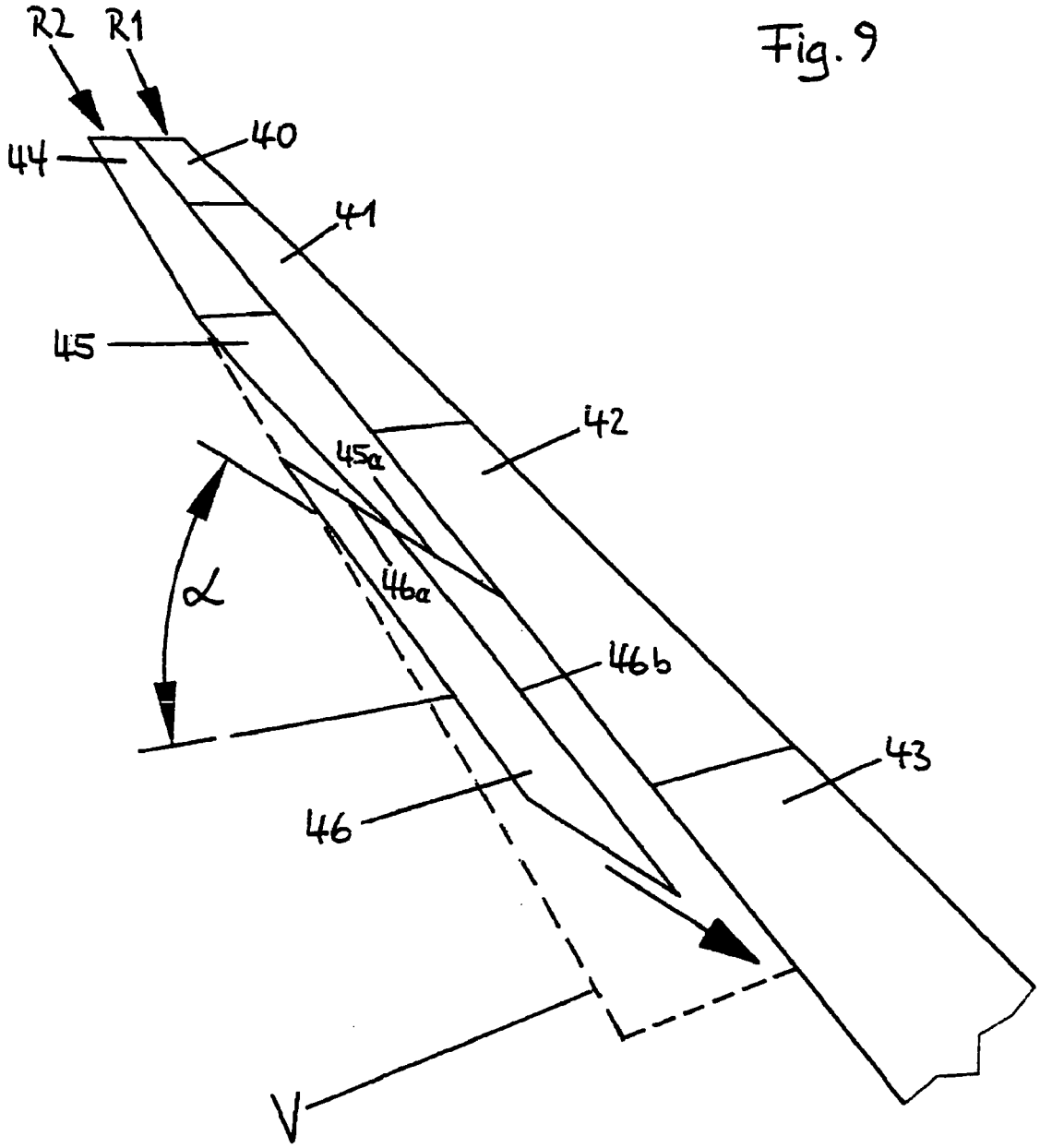

In order to lay a new panel in the second row, several alternative procedural steps can be performed, two alternatives of which are described on the basis of FIGS. 8 and 9. A further alternative is explained without an illustration.

When laying a new panel 46 in the second row, one of its long sides has to be interlocked with first row R1 and one of its short sides with laid panel 45. A short side of new panel 46 is always first interlocked with laid panel 45.

According to FIG. 8, free end 45*a* is pivoted upwards out of the laying plane through a pivoting angle α about interlocked long narrow side 45*b*. Panel 45 is twisted in such a way during the process that the dimension of pivoting angle α decreases from free end 45*a* towards interlocked end 45*c*. According to FIG. 8, interlocked end 45*c* remains in place in the laying plane. In this position, new panel 46 is set at an angle relative to panel 45 on free end 45*a* of the latter. Panel 46 can initially not be set against the whole length of the short side, because panel 45 is already interlocked with panels 41 and 42 of the first row. Panel 46 is now pivoted in the direction of arrow A until it is likewise positioned at pivoting angle a relative to the laying plane, as indicated by dotted pivoting position 46'. In pivoting position 46', panel 46 is slid in the direction of arrow B and the joint projection of panel 46 is inserted into the joint recess of panels 42 and 43 of first row R1. In this context, the short narrow side of panel 46 is simultaneously slid completely onto short narrow side 45*a* of panel 45. Finally, panels 45 and 46 are jointly pivoted into the laying plane in the direction of arrow C and interlocked with the panels of first row R1.

Damage to the retaining profiles due to a high degree of deformation during laying and interlocking is avoided.

The alternative laying method according to FIG. 9 likewise provides for free end 45*a* to be pivoted upwards out of the laying plane by a pivoting angle α about interlocked long narrow side 45*b*, where panel 45 is twisted and its free end 45*a* is inclined through a pivoting angle α relative to the laying plane. Interlocked end 45*c* again remains in place in the laying plane. In contrast to FIG. 8, panel 46 is now likewise positioned at the pivoting angle α relative to the laying plane and its short side 46*a* is slid in the longitudinal direction onto the retaining profile of short side 45*a* of panel 45. In this inclined position, the joint projection of long side 46*b* of panel 46 is immediately inserted into the joint recess of panels 42 and 43 of first row R1. Finally, panels 45 and 46 are jointly pivoted into the laying plane and interlocked with the panels of first row R1.

The alternatives not shown for laying and interlocking panels consist in first interlocking the short narrow ends of panels 45 and 46 in the laying plane. The alternatives described here can be followed by examining FIGS. 8 and 9, which is why reference numbers are also given for the alternatives not illustrated.

According to one of the alternatives, the retaining profiles of short narrow sides 45*a* and 46*a* of panels 45 and 46 are slid into each other in the longitudinal direction while both panels 45 and 46 remain in place in the laying plane. According to another alternative, panel 45 lies in the laying plane and panel 46 is set at an angle against short narrow side 45*a* of panel 45 and then pivoted into the laying plane.

According to the above alternative procedural steps for interlocking panels 45 in the laying plane, the long side of panel 46 is not yet interlocked with panels 42 and 43 of first row R1. To this end, panel 46 and end 45*a* of panel 45 must be lifted into the previously described inclined position at pivoting angle α. The joint projection of long side 46*b* of panel 46 is then inserted into the joint recess of panels 42 and 43 of first row R1, and panels 45 and 46 are finally jointly interlocked with panels 42 and 43 of first row R1 by being pivoted into laying plane V.

Although certain presently preferred embodiments of the disclosed invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A method for laying and interlocking floor panels provided with a first pair and a second pair of opposite panel sides, each of which pair of sides displays complementary retaining profiles extending over a length of the sides, the method comprising:

(a) pivoting a first panel side of said first pair of sides of a previously laid panel upward so as to twist said previously laid panel about an axis extending through said previously laid panel;

(b) interlocking a second panel side of said first pair of sides of a new panel with said first panel side of said first pair of sides of said previously laid panel, such that the new panel assumes an inclined position in which the retaining profile of a first panel side of said second pair of sides of said new panel can be inserted into the complementary retaining profile of one or more stationary panels in a row adjacent said new panel and said previously laid panel; and (c) pivoting the inclined new panel and the previously laid panel together into a common plane of stationary panels.

2. The method of claim 1, further comprising the steps of:

prior to said step (c), inserting the retaining profile of a first panel side of said second pair of sides of said new panel into the complementary retaining profile of one or more stationary panels in the row adjacent said new panel and said previously laid panel.

3. The method of claim 1, step (b) further comprising:

sliding said second panel side of said first pair of sides of said new panel into said first panel side of said first pair of sides of said previously laid panel in a longitudinal direction of the panel sides in a common line.

4. The method of claim 1, step (b) further comprising:

initially inserting the second panel side of said first pair of sides of said new panel into said first panel side of said first pair of sides of said previously laid panel in an inclined position relative to the previously laid panel, and subsequently pivoting the new panel into the plane of the first panel side of said first pair of sides of said previously laid panel.

5. A method for laying and interlocking floor panels provided with a pair of opposite long sides and a pair of opposite short sides, each of which pair of sides displays complementary retaining profiles extending over a length of the sides, the method comprising:

(a) pivoting a short side of a previously laid panel upward so as to twist said previously laid panel about an axis extending through said previously laid panel;

(b) interlocking a complementary short side of a new panel with said short side of said previously laid panel, such that the new panel assumes an inclined position in which the retaining profile of a first long side of said new panel can be inserted into the complementary retaining profile of one or more stationary panels in a row adjacent said new panel and said previously laid panel; and (c) pivoting the inclined new panel and the previously laid panel together into a common plane of stationary panels.

6. The method of claim 5, further comprising the steps of:

prior to said step (c), inserting the retaining profile of a long side of said new panel into the complementary retaining profile of one or more stationary panels in the row adjacent said new panel and said previously laid panel.

7. The method of claim 5, step (b) further comprising:

sliding said complementary short side of said new panel into said short side of said previously laid panel in a longitudinal direction of the panel sides in a common line.

8. The method of claim 5, step (b) further comprising:

initially inserting the complementary short side of said new panel into said short side of said previously laid panel in an inclined position relative to the previously laid panel, and subsequently pivoting the new panel about the short side of said previously laid panel to form a common plane with said new panel and said previously laid panel.

9. A method of joining floor panels of identical construction, said floor panels being provided with a pair of opposite long edges and a pair of opposite short edges, each of which pair of edges displays complementary retaining profiles extending over a length of the edges, the method comprising:

(a) placing a new panel adjacent a long edge of a previously laid panel in an adjacent row and adjacent a first short edge of a previously laid panel in the same row;

(b) interlocking a complementary short edge of said new panel to said first short edge of the previously laid panel in the same row;

(c) angling up the first short edge of the previously laid panel in the same row so as to position said first short edge in a plane distinct from a plane including a second short edge of said previously laid panel in the same row (d) joining a complementary long edge of said new panel with said long edge of said previously laid panel in the adjacent row while maintaining the new panel and the first short edge of the previously laid panel in the same row in an inclined position with respect to the previously laid panel in the adjacent row; and (e) angling down the new panel and the first short edge of the previously laid panel in the same row to form a common plane with said new panel and said previously laid panel.

10. The method of claim 9, wherein the angling up of a first short edge of the previously laid panel in the same row causes the previously laid panel in the same row to twist along its longitudinal axis.

11. The method of claim 9, step (b) further comprising:

sliding the complementary short edge of said new panel into said first short edge of the previously laid panel in the same row in a longitudinal direction of the panel edges in a common plane.

12. The method of claim 9, step (b) further comprising:

initially inserting the complementary short edge of said new panel into said first short edge of the previously laid panel in the same row in an inclined position relative to the previously laid panel in the same row, and subsequently pivoting the new panel into the plane of the previously laid panel in the same row.

13. A method for placing and locking rectangular, plate-like panels, especially floor panels, that display holding profiles extending over the full length of the edges, on opposite long edges and on opposite short edges, the opposite holding profiles being designed in essentially complementary form, said method comprising the steps of:

joining panels of a first row together at the short edges, either by the complementary holding profiles of a placed panel and a new panel being inserted into each other in the longitudinal direction of the short edges, or by the holding profile of a new panel first being inclined relative to the placed panel and inserted into the complementary profile of the placed panel and then locked with the placed panel, both in the direction perpendicular to the joined edges and in the direction perpendicular to the plane of the placed panels, by being pivoted into the plane of the placed panel, placing a new panel in a second row by the holding profile of its long edge initially being inclined relative to the long edge of a panel of the first row, inserted into the holding profile of the latter and subsequently pivoted into the plane of the placed panels, and where the short edge of the new panel, whose short edge is to be locked with the short edge of the panel placed in the second row and whose long edge is to be locked with the long edge of a panel placed in the first row, is first locked with the panel in the second row, pivoting the new panel upwards out of the plane of the placed panels along the long edge of a panel placed in the first row, where the panel of the second row, previously locked with the new panel at the short edge, is also pivoted upwards into an inclined position at this end together with the new panel, where the inclination decreases towards the locked short edge of the panel, and where the long holding profile of the new panel can be inserted into the complementary holding profile of the panel placed in the first row in this inclined position, inserting the long holding profile of the new panel into the complementary holding profile of the panel placed in the first row to join the new panel to the panel placed in the first row, and following joining, pivoting the inclined new panel and the panel locked with the new panel on one short edge in the second row into the plane of the placed panels.

14. The method according to claim 13 where one holding profile is designed as an articulated projection with a convex curvature and the complementary holding profile is designed as a socket recess with a concave curvature, where each articulated projection of a new panel to be placed in the second row can, by slightly expanding the socket recess of a panel previously placed in the second row, be inserted into the latter, and the new panel to be placed in the second row is, finally, locked by being pivoted into the plane of the panel previously placed in the second row.

15. A method for placing a new, rectangular, plate-like panel in a second row of panels, where the new panel to be placed in the second row displays holding profiles that enable the new panel to be locked both with panels of a first row and with a previously placed panel in the second row, especially for floor panels, where the new panel to be placed in the second row is locked both on one long edge with a first row of panels, and on one short edge with a panel that has already been placed in the second row, where the panels display holding profiles, extending over the full length of the edges, on opposite long edges and on opposite short edges, opposite holding profiles being designed in essentially complementary form, said method comprising the steps of:

locking one of the short edges of the new panel to be placed in the second row with the panel previously placed in the second row by the free end of the latter being pivoted upwards out of the placing plane through a pivoting angle about the locked long edge, and the panel previously placed in the second row is twisted in such a way that the amount of the pivoting angle decreases from the free end to the locked end, wherein part of the short edge of the new panel to be placed in the second row is placed, in this position and at an inclination relative to the panel previously placed in the second row, against the free end of the latter, pivoting the new panel to be placed in the second row into a pivoting position until it is likewise positioned at the pivoting angle relative to the placing plane, where the new panel to be placed in the second row is displaced from the pivoting position inserting the holding profile of the new panel to be placed in the second row into the holding profiles of the panels of the first row, where the short edge of the new panel to be placed in the second row is simultaneously slid completely onto the short edge of the panel previously placed in the second row and, jointly pivoting the panel previously placed in the second row and the new panel to be placed in the second row into the placing plane such that said panels are locked with the panels of the first row.

16. The method according to claim 15 where one holding profile is designed as an articulated projection with a convex curvature and the complementary holding profile is designed as a socket recess with a concave curvature, where each articulated projection of a new panel to be placed in the second row can, by slightly expanding the socket recess of a panel previously placed in the second row, be inserted into the latter, and the new panel to be placed in the second row is, finally, locked by being pivoted into the plane of the panel previously placed in the second row.

17. A method for laying and interlocking floor panels provided with a pair of opposite long sides and a pair of opposite short sides, each of which pair of sides displays complementary retaining profiles extending over a length of the sides, the method comprising:

(a) interlocking a short side of a new panel with a complementary short side of a previously laid panel in a row of panels, wherein said previously laid panel has already been interlocked on its long side with a complementary long side of a panel in an adjacent row of panels;

(b) pivoting the short side of said previously laid panel upward so as to twist said previously laid panel about an axis extending through said previously laid panel such that the new panel assumes an inclined position in which the retaining profile of a first long side of said new panel can be inserted into a complementary retaining profile of one or more stationary panels in the row adjacent said new panel and said previously laid panel; and (c) pivoting the inclined new panel and the previously laid panel together into a common plane of stationary panels.

18. The method of claim 17, further comprising the steps of:

prior to said step (c), inserting the retaining profile of the first long side of said new panel into the complementary retaining profile of one or more stationary panels in the row adjacent said new panel and said previously laid panel.

19. The method of claim 17, step (a) further comprising:

sliding said complementary short side of said new panel into said short side of said previously laid panel in a longitudinal direction of the panel sides in a common line.

20. The method of claim 17, step (a) further comprising:

initially inserting the complementary short side of said new panel into said short side of said previously laid panel in an inclined position relative to the previously laid panel, and subsequently pivoting the new panel about the short side of said previously laid panel to form a common plane with said new panel and said previously laid panel.

* * * * *

UNITED STATES PATENT AND TRADEMARK OFFICE

CERTIFICATE OF CORRECTION

PATENT NO. : 7,065,935 C1
APPLICATION NO. : 90/008248
DATED : October 28, 2008
INVENTOR(S) : Ralf Eisermann It is certified that error appears in the above-identified patent and that said Letters Patent is hereby corrected as shown below:

Column 1, line 48 the word "that" appears twice, but should only appear once and should read as follows:
-- *gitudinal axis such that a portion of the comple-* -- and

Column 4, line 5, the word "that" appears twice, but should only appear once and should read as follows:

-- *row to twist along its longitudinal axis such that a* --.

Signed and Sealed this

Tenth Day of March, 2009

JOHN DOLL
*Acting Director of the United States Patent and Trademark Office*

US007065935C1

(12) EX PARTE REEXAMINATION CERTIFICATE (6495th)

United States Patent

Ralf

(10) Number: US 7,065,935 C1

(45) Certificate Issued: *Oct. 28, 2008

(54) METHOD FOR LAYERING AND INTERLOCKING PANELS

(75) Inventor: Eisermann Ralf, Cochem (DE)

(73) Assignee: Akzenta Paneele & Profile GmbH, Kaisersesch (DE)

Reexamination Request:
No. 90/008,248, Sep. 28, 2006

Reexamination Certificate for:

| | |
|---|---|
| Patent No.: | **7,065,935** |
| Issued: | **Jun. 27, 2006** |
| Appl. No.: | **10/911,280** |
| Filed: | **Aug. 4, 2004** |

( * ) Notice: This patent is subject to a terminal disclaimer.

Related U.S. Application Data

(63) Continuation of application No. 09/609,251, filed on Jun. 30, 2000, now Pat. No. 6,804,926, which is a continuation of application No. PCT/DE00/00870, filed on Mar. 22, 2000.

(30) Foreign Application Priority Data

Jul. 2, 1999 (DE) ..... 299 11 462 U

(51) Int. Cl.
*E04F 15/02* (2006.01)

(52) U.S. Cl. ..... 52/747.1; 52/592.1; 52/592.2

(58) Field of Classification Search ..... None
See application file for complete search history.

(56) References Cited

U.S. PATENT DOCUMENTS

| | | | |
|---|---|---|---|
| 4,426,820 | A | 1/1984 | Terbrack et al. |
| 6,023,907 | A | 2/2000 | Pervan |

OTHER PUBLICATIONS

Fiboloc Floor Laying Instructions. Facimile from Norske Skog Flooring to Mrs. Luhr of Botex & Helms. (English language translation of original German language facimile) (fax date May 10, 1999).*

Uniclic laminated flooring instructions ("The 99050 Unilin Instructions"), date unknown.

Documents allegedly attached to displays in stores selling Fiboloc laminate flooring, and installation instructions allegedly included in some boxes of flooring product ("the Fiboloc Instructions"), Valinge Aluminum AB and Norske Skog Flooring (USA) Inc., dates unknown.

Quick–Step Uniclic laminated flooring instructions ("the 2000 Unilin Instructions"). BHK of America, Inc., date unknown.

(Continued)

*Primary Examiner*—David O. Reip

(57) ABSTRACT

Rectangular floor panels, a fastening system for joining the panels, and a method for laying and interlocking the panels are disclosed. The panels are provided complementary, form-fitting retaining profiles extending over the length of the sides. The complementary edges of the panels allow two adjacent panels to be positively joined such that displacement of the panels away from one another is prevented, while enabling articulation of the panels with respect to one another at the joint location. The method of installation provides for installing a new panel to a first row and a panel in a second row by first joining the new panel to the panel of the second row at its short side, followed by pivoting the new panel upwards out of the plane of the laid panels along its long side, along with at least the adjacent end of the first panel in the second row, into an inclined position, and sliding the new panel into the retaining profile of the panels in the first row. The new panel and the raised end of the panel in the second row are then pivoted down into the plane of the laid panels. Laying of panels continues according to this process until the complete floor assembly has been laid.

Quick–Step Uniclic laminated flooring instructions ("the 1998 Unilin Instructions"), BHK of America, Inc., date unknown.

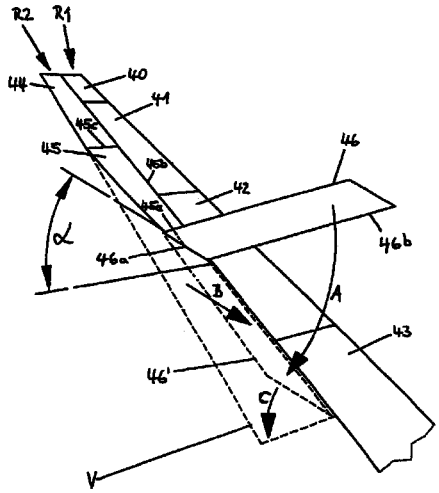

OTHER PUBLICATIONS

Quick–Step Uniclic laminated flooring instructions, BHK of America, Inc., date unknown ("the Unilin 1998 Instructions").
Quick–Step Uniclic laminated flooring instructions, BHK of America, Inc., date unknown ("the Unilin 2000 Instructions").
English language translation of Beernaert & Missinne BVBA Printing Shop Receipt dated Mar. 12, 1999.
Ex. 1 to NPL2, Quick Step, "Uniclic System—Laminated flooring," BHK of America, Inc., UN–A 000007–000010.
Ex. 2 to NPL2, Quick Step, "Uniclic System—Laminate flooring," BHK of America, Inc., UN–A 000271–000274.
Ex. 3 to NPL2, Quick Step Majestic, "Uniclic System—Laminate flooring," BHK of America, Inc., UN–A 000023–000026.
Ex. 4 to NPL2, Välinge Aluminum, "Fiboloc Installation Instruction," accessed at http://www.valingealuminum.se, Välinge Aluminum AB, UN–A 000281–000284.
Ex..2 to NPL7, United States Patent No. 6,804,926 B1.
Ex. 9 to NPL7, United States Patent No. 7,065,935 B2.
Ex. 12 to NPL7, Quick Step, "Uniclic System—Laminate flooring," BHK of America, Inc., UN–A 000271–000274.
Ex. 13 to NPL7, Quick Step, "Uniclic System—Laminate flooring," BHK of America, Inc., UN–A 001869–001874.
Ex. 14 to NPL7, Välinge Aluminum, "Fiboloc Installation Instruction," accessed at http://www.valingealulminum.se, Välinge Aluminum AB, UN–A 000281–000284.
Ex. 2 to NPL25, United States International Trade Commission, *Certain Flooring Products*, "Final Initial Determination," Nov. 2, 2001, 2 pages.
Ex. 3 to NPL25, Cover Letter to United States Patent and Trademark Office for U.S. Appl. No. 09/609,251, filed Jun. 30, 2000, UN–A 000474–000475.
Ex. 6 to NPL25, Columbia Flooring, "Columbia Classic Clic," 6 pages.
Ex. 7 to NPL25, Quick Step, "Uniclic Installation Instructions," UN–A 000001–000006.
Extract of webpage www.quick–step.com, Unilin Décor nv, B–8710 Wielsbeke, Belgium. (May 9, 1999).
Pervan, D. Short side angling of Fiboloc and Alloc, T99/install–short–990325, date unknown.
Fiboloc Floor Laying Instructions. Norske Skog Flooring. (German Language), date unknown.

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 10 is cancelled.

Claims 9, 13 and 17 are determined to be patentable as amended.

Claims 12, 18 and 20, dependent on an amended claim, are determined to be patentable.

New claim 21 is added and determined to be patentable.

Claims 1–8, 11, 14–16 and 19 were not reexamined.

9. A method of joining floor panels of identical construction, said floor panels being provided with a pair of opposite long edges and a pair of opposite short edges, each of which pair of edges displays complementary retaining profiles extending over a length of the edges, the method comprising:

(a) placing a new panel adjacent a long edge of a previously laid panel in an adjacent row and adjacent a first short edge of a previously laid panel in the same row;

(b) interlocking a complementary short edge of said new panel to said first short edge of the previously laid panel in the same row;

(c) angling up the first short edge of the previously laid panel in the same row so as to position said first short edge in a plane distinct from a plane including a second short edge of said previously laid panel in the same row*, wherein the angling up of a first short edge of the previously laid panel in the same row causes the previously laid panel in the same row to twist along its longitudinal axis such that that a portion of the complementary retaining profiles of the pair of opposite long sides of the panel laid in the second row and a panel from the first row are interlocked, and a portion of the complementary retaining profiles of the pair of opposite long sides of the panel laid in the second row and a panel from the first row are non-interlocked;*

(d) joining a complementary long edge of said new panel with said long edge of said previously laid panel in the adjacent row while maintaining the new panel and the first short edge of the previously laid panel in the same row in an inclined position with respect to the previously laid panel in the adjacent row; and (e) angling down the new panel and the first short edge of the previously laid panel in the same row to form a common plane with said new panel and said previously laid panel.

13. A method for placing and locking rectangular, plate-like panels, especially floor panels, that display holding profiles extending over the full length of the edges, on opposite long edges and on opposite short edges, the opposite holding profiles being designed in essentially complementary form, said method comprising the steps of:

joining panels of a first row together at the short edges, either by the complementary holding profiles of a placed panel and a new panel being inserted into each other in the longitudinal direction of the short edges, or by the holding profile of a new panel first being inclined relative to the placed panel and inserted into the complementary profile of the placed panel and then locked with the placed panel, both in the direction perpendicular to the joined edges and in the direction perpendicular to the plane of the placed panels, by being pivoted into the plane of the placed panel[.]*;* placing a new panel in a second row by the holding profile of its long edge initially being inclined relative to the long edge of a panel of the first row, inserted into the holding profile of the latter and subsequently pivoted into the plane of the placed panels, and where the short edge of the new panel, whose short edge is to be locked with the short edge of the panel placed in the second row and whose long edge is to be locked with the long edge of a panel placed in the first row, is first locked with the panel in the second row, pivoting the new panel upwards out of the plane of the placed panels along the long edge of a panel placed in the first row, where the panel of the second row, previously locked with the new panel at the short edge, is also pivoted upwards into an inclined position at this end together with the new panel, where the inclination decreases towards the locked short edge of the panel, *where a portion of the complementary holding profiles of the pair of opposite long sides of the panel laid in the second row and a panel from the first row are interlocked, and a portion of the complementary holding profiles of the pair of opposite long sides of the panel laid in the second row and a panel from the first row are non-interlocked,* and where the long holding profile of the new panel can be inserted into the complementary holding profile of the panel placed in the first row in this inclined position[.]*;* inserting the long holding profile of the new panel into the complementary holding profile of the panel placed in the first row to join the new panel to the panel placed in the first row[.]*;* and following joining, pivoting the inclined new panel and the panel locked with the new panel on one short edge in the second row into the plane of the placed panels.

17. A method for laying and interlocking floor panels provided with a pair of opposite long sides and a pair of opposite short sides, each of which pair of sides displays complementary retaining profiles extending over a length of the sides, the method comprising:

(a) interlocking a short side of a new panel with a complementary short side of a previously laid panel in a row of panels, wherein said previously laid panel has already been interlocked on its long side with a complementary long side of a panel in an adjacent row of panels;

(b) pivoting the short side of said previously laid panel upward so as to twist said previously laid panel about an axis extending through said previously laid panel such that the new panel assumes an inclined position in which *a portion of the complementary retaining profiles of the pair of opposite long sides of the panel laid in the second row and a panel from the first row are interlocked, and a portion of the complementary retaining profiles of the pair of opposite long sides of the*

*panel laid in the second row and a panel from the first row are non-interlocked and* the retaining profile of a first long side of said new panel can be inserted into a complementary retaining profile of one or more stationary panels in the row adjacent said new panel and said previously laid panel; and (c) pivoting the inclined new panel and the previously laid panel together into a common plane of stationary panels.

*21. A method of joining floor panels of identical construction, said floor panels being provided with a pair of opposite long edges and a pair of opposite short edges, each of which pair of edges displays complementary retaining profiles extending over a length of the edges, the method comprising:*

*(a) placing a new panel adjacent a long edge of a previously laid panel in an adjacent row and adjacent a first short edge of a previously laid panel in the same row;*

*(b) interlocking a complementary short edge of said new panel to said first short edge of the previously laid panel in the same row;*

*(c) angling up the first short edge of the previously laid panel in the same row so as to position said first short edge at a first angle relative to the adjacent row and so as to position a second short edge at a second angle relative to the adjacent row, the first angle being distinct from the second angle, and wherein the angling up of a first short edge of the previously laid panel in the same row causes the previously laid panel in the same row to twist along its longitudinal axis such that that a portion of the complementary retaining profiles of the pair of opposite long sides of the panel laid in the second row and a panel from the first row are interlocked, and a portion of the complementary retaining profiles of the pair of opposite long sides of the panel laid in the second row and a panel from the first row are non-interlocked;*

*(d) joining a complementary long edge of said new panel with said long edge of said previously laid panel in the adjacent row while maintaining the new panel and the first short edge of the previously laid panel in the same row in an inclined position with respect to the previously laid panel in the adjacent row; and*

*(e) angling down the new panel and the first short edge of the previously laid panel in the same row to form a common plane with said new panel and said previously laid panel.*

* * * * *